United States Patent [19]

Weber-Grabau et al.

[11] Patent Number: 4,771,172

[45] Date of Patent: Sep. 13, 1988

[54] METHOD OF INCREASING THE DYNAMIC RANGE AND SENSITIVITY OF A QUADRUPOLE ION TRAP MASS SPECTROMETER OPERATING IN THE CHEMICAL IONIZATION MODE

[75] Inventors: Michael Weber-Grabau, San Jose; Stephen C. Bradshaw, Watsonville; John E. P. Syka, Sunnyvale, all of Calif.

[73] Assignee: Finnigan Corporation, San Jose, Calif.

[21] Appl. No.: 53,359

[22] Filed: May 22, 1987

[51] Int. Cl.[4] ..... H01J 49/42

[52] U.S. Cl. ..... 250/282; 250/283; 250/290; 250/291; 250/292; 250/252.1

[58] Field of Search ..... 250/282, 283, 292, 291, 250/290, 252.1

[56] References Cited

U.S. PATENT DOCUMENTS

| | | | |
|---|---|---|---|
| 3,502,867 | 3/1970 | Beauchamp | 250/291 |
| 3,937,955 | 2/1976 | Comisarow et al. | 250/283 |
| 4,105,917 | 8/1978 | McIver et al. | 250/291 |
| 4,464,570 | 8/1984 | Allemann et al. | 250/291 |
| 4,535,235 | 8/1985 | McIver | 250/282 |
| 4,540,884 | 9/1985 | Stafford et al. | 250/282 |
| 4,686,367 | 8/1987 | Louris et al. | 250/290 |

*Primary Examiner*—Bruce C. Anderson
*Assistant Examiner*—Jack I. Berman
*Attorney, Agent, or Firm*—Flehr, Hohbach, Test, Albritton & Herbert

[57] ABSTRACT

A method is disclosed for increasing the dynamic range and sensitivity of a quadrupole ion trap mass spectrometer operating in the chemical ionization mode. Prior to mass analysis, a prescan is performed with the ion trap and the ionization and reaction periods are adjusted to produce enough stored product or analyte ions to generate a good signal-to-noise ratio in the detection of trace amounts of analyte, yet not so many analyte ions that resolution in the mass spectrum is lost. A mass analysis scan is then performed with the ion trap using the ionization and reaction periods predetermined during the prescan.

7 Claims, 2 Drawing Sheets

METHOD OF INCREASING THE DYNAMIC RANGE AND SENSITIVITY OF A QUADRUPOLE ION TRAP MASS SPECTROMETER OPERATING IN THE CHEMICAL IONIZATION MODE

The present invention relates to a method of increasing the dynamic range and sensitivity of an ion trap mass spectrometer operating in the chemical ionization mode.

Ion trap mass spectrometers, or quadrupole ion stores, have been known for many years and described by a number of authors. They are devices in which ions are formed and contained within a physical structure by means of electrostatic fields such as RF, DC and a combination thereof. In general, a quadrupole electric field provides an ion storage region by the use of a hyperbolic electrode structure or a spherical electrode structure which provides an equivalent quadrupole trapping field.

Mass storage is generally achieved by operating the trap electrodes with values of RF voltage V, its frequency f, DC voltage U and device size $r_0$ such that ions having their mass-to-charge ratios within a finite range are stably trapped inside the device. The aforementioned parameters are sometimes referred to as scanning parameters and have a fixed relationship to the mass-to-charge ratios of the trapped ions. For trapped ions, there is a distinctive characteristic frequency for each value of mass-to-charge ratio. In one method for detection of the ions, these frequencies can be determined by a frequency tuned circuit which couples to the oscillating motion of the ions within the trap, and then the mass-to-charge ratio may be determined by use of an improved analyzing technique.

In spite of the relative length of time during which ion trap mass spectrometers and methods of using them for mass analyzing a sample have been known they have not gained popularity until recently because these mass selection techniques are insufficient and difficult to implement and yield poor mass resolution and limited mass range. A new method of ion trap operation described in U.S. Pat. No. 4,540,884, has overcome most of the past limitations and is gaining popularity.

The present invention is directed to performing chemical ionization mass spectrometry with a quadrupole ion trap mass spectrometer. Chemical ionization mass spectrometry (CI) has been widely used by analytical chemists since its introduction in 1966 by Munson and Field, J. Amer. Chem. Soc. 88, 2621 (1966). In CI mass spectrometry ionization of the sample or analyte of interest is effected by gas-phase ion/molecule reactions rather than by electron impact, photon impact, or field ionization/desorption. CI offers the capability of controlling sample fragmentation through the choice of appropriate reagent gas. This is because the degree to which fragmentation occurs depends on the amount of energy that a reagent ion can transfer during the reaction with the analyte molecule. A higher energy transfer will usually result in more fragmentation. It is also possible that a reagent ion will not react at all with certain classes of analyte molecules, and very strangly with others. Thus by choice of a suitable reagent gas, a high specificity towards the detection of certain classes of components can be achieved. In particular, since fragmentation is often reduced relative to that obtained with electron impact, simple spectra can often be obtained with enhanced molecular weight information.

Various parameters determine the number of analyte ions created. Among these are: reagent ion concentration; analyte concentration or pressure; reaction time (time available for a reagent ion to collide and react with an analyte molecule); and reaction rate, which depends on the physical and chemical properties of both reagent ion and sample.

The relatively short ion residence times in the sources of conventional CI mass spectrometers necessitates high reagent gas pressures (0.1–1 torr) for significant ionization of the sample. To overcome this and other disadvantages, various approaches have been used to increase residence times of ions in the source so that the number of collisions between sample neutral molecules and the reagent ions is increased prior to mass analysis.

Among these techniques, ion cyclotron resonance (ICR) has seen increasing use. Since the high pressures needed in conventional CI sources can not be used in most ICR equipment (because the analyser region requires a very high vacuum), the source region must be maintained at a low pressure. Gross and co-workers have demonstrated the feasibility of obtaining CI mass spectra by the ICR technique with the reagent gas in low $10^{-6}$ torr range and the analyte in the $10^{-7}$ to $10^{-8}$ torr range. (Ghaderi, Kulkarni, Ledford, Wilkins and Gross, Anal. Chem., 53, 428 (1981)). These workers allowed a reaction period after ionization for the formation of reagent ions and the subsequent reaction with the sample neutrals. for example, for methane at $2\times10^{-6}$ torr, the relative proportion of $CH_5=$ to $C_2H_5=$ became constant after 100 ms.

So, when methane ($P=2\times10^{-6}$ torr), was the reagent gas, CI by Fourier transform ICR was obtained by introducing a low partial pressure of sample (e.g., $5\times10^{-8}$ torr), ionizing via electron impact, waiting for a 100 ms reaction period, and detecting by using the standard Fourier transform ICR technique. Since the sample is present at a concentration of 1% of the present reagent gas, significant electron impact ionization of the analyte does occur.

Todd and co-workers have used the quadrupole ion storage trap as a source for a quadrupole mass spectrometer. (Lawson, Bonner and Todd, J. Phys E. 6, 357 (1973)). The ions were created within the trap under RF-only storage conditions so that a wide mass range was stored. The ions then exited the trap because of space-charge repulsion (or were ejected by a suitable voltage pulse to one of the end-caps) and were mass-analyzed by a conventional quadrupole. In either case, in the presence of a reagent gas the residence time was adequate to achieve chemical ionization. Of course, since the sample is also present during the ionization period, EI fragments may appear in the spectrum with this method.

In U.S. Pat. No. 4,686,367 there is described a mode of operation for the quadrupole ion storage trap to obtain CI mass spectra that offers advantages over the methods previously used with quadrupole traps and the methods previously reported for ICR instruments. The quadrupole ion trap is used for both the reaction of neutral sample molecules with reagent ions and for mass analysis of the products. Fragments from electron impact of the analyte can be suppressed by creating conditions within the trap under which reagent ions are stored during ionization but most analyte ions are not.

When operating a mass spectrometer in connection with gas chromatographs the concentration of the sample, which enters the ion trap for ionization and analysis varies. Analyte compounds generally have a wide range of reaction rates. At low concentrations and/or low reaction rates a compound may not be detected with sufficient signal-to-noise ratio because not enough product ions are formed. A high concentration and/or high reaction rates to many product ions may be formed resulting in a loss of mass resolution.

It is an object of the present invention to provide a method for enhancing the sensitivity and increasing the dynamic range of an ion trap mass spectrometer.

In accordance with the present invention the reaction parameters are adjusted by performing a prescan and using the data obtained to adjust the reaction parameters to provide optimum conditions for the CI reaction.

Figure 1:
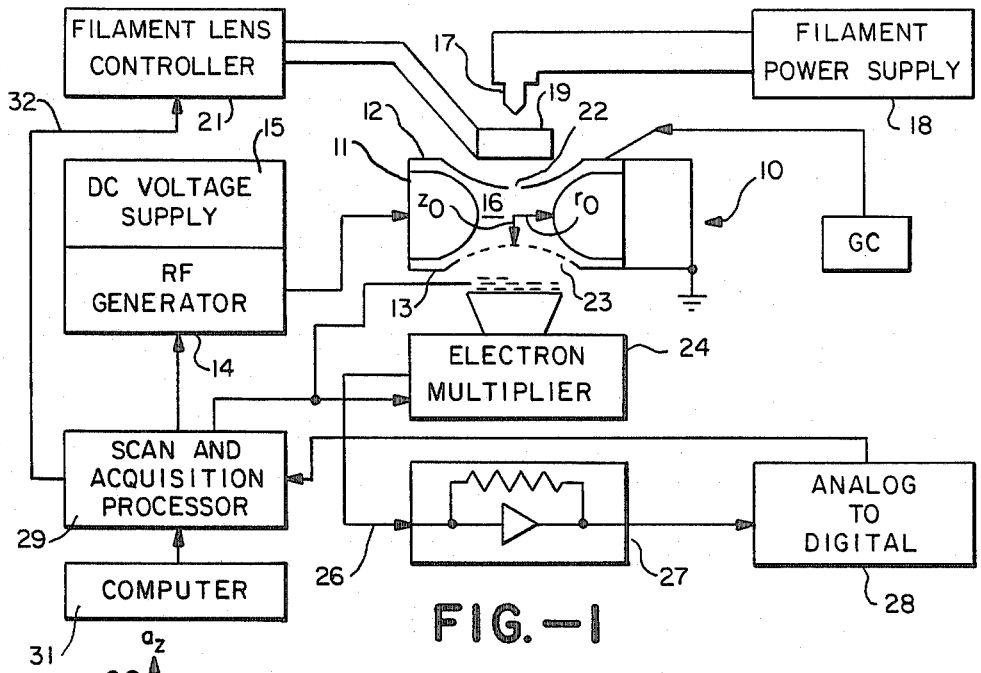
FIG. 1 is a simplified schematic of a quadrupole ion trap along with a block diagram of associated electrical circuits for use in practicing the method of the present invention.

There is shown in FIG. 1 at 10 a three-dimensional ion trap which includes a ring electrode 11 and two end caps 12 and 13 facing each other. A radio frequency (RF) voltage generator 14 and a DC power supply 15 are connected to the ring electrode 11 to suply a radio frequency voltage V and DC voltage U between the end caps and the ring electrode. These voltages provide the quadrupole field for trapping ions within the ion storage region or volume 16 having a radius $r_0$ and a vertical dimension $z_0$ ($z_0^2=r_0^2/2$). A filament 17 which is fed by a filament power supply 18 is disposed to provide an ionizing electron beam for ionizing the sample molecules introduced into the ion storage region 16. A cylindrical gate electrode and lens 19 is powered by a filament lens controller 21. The gate electrode provides control to gate the electron beam on and off as desired. End cap 12 includes an aperture through which the electron beam projects. The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29. Scan and acquisition processor 29 is connected to the RF generator 14 to allow the magnitude and/or frequency of the fundamental RF voltage to be varied for providing mass selection. The controller gates the filament lens controller 21 via line 21 to provide an ionizing electron beam. The scan and acquisition processor is controlled by computer 31.

Figure 2:
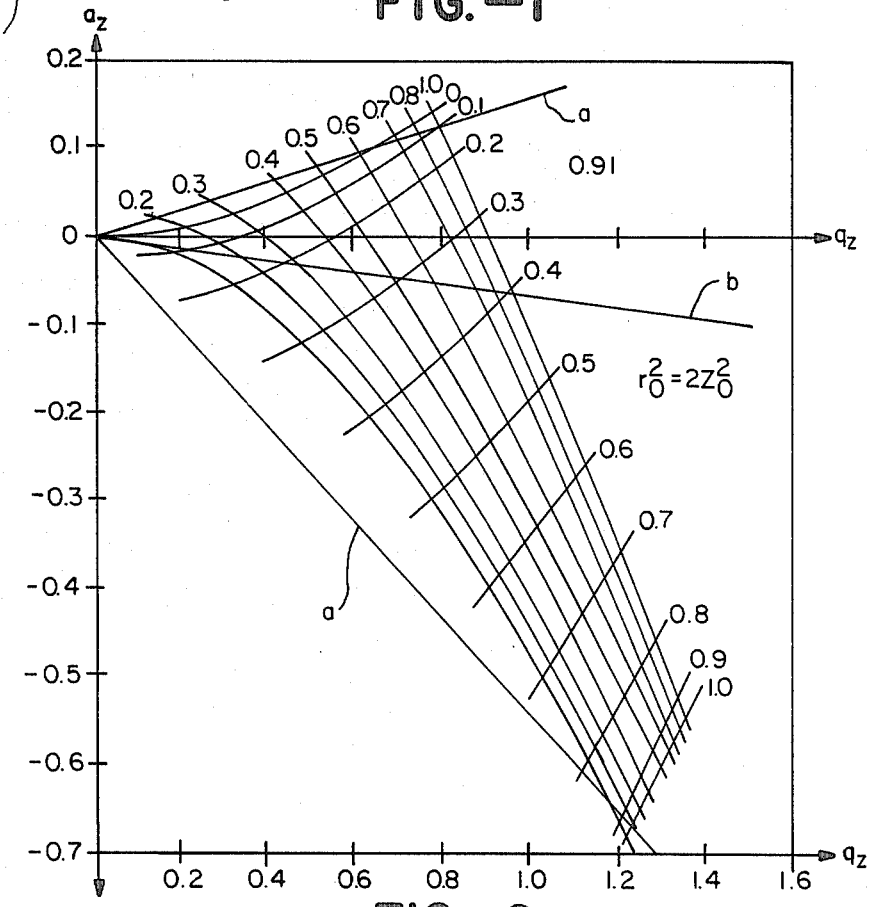
FIG. 2 is a stability envelope for a quadrupole ion trap of the type shown in FIG. 1.

The symmetric three dimensional fields in the ion trap 10 lead to the well known stability diagram shown in FIG. 2. The parameters a and q in FIG. 2 are defined as:

$$a=-8eU/mr_0^2\omega^2$$

$$q=4eV/mr_0^2\omega^2$$

where e and m are respectively charge and mass of charged particle. For any particular ion, the values of a and q must be within the stability envelope if it is to be trapped within the quadrupole fields of the ion trap device.

The type of trajectory a charged particle has in a described three-dimensional quadrupole field depends on how the specific mass of the particle, m/e, and the applied field parameters, U, V, $r_0$ and $\omega$ combined to map onto the stability diagram. If the scanning parameters combine to map inside the stability envelope then the given particle has a stable trajectory in the defined field. A charged particle having a table trajectory in a three-dimensional quadrupole field is constrained to an orbit about the center of the field. Such particles can be thought of as trapped by the field. If for a particle m/e, U, V, $r_0$ and $\omega$ combine to map outside the stability envelope on the stability diagram, then the given particle has an unstable trajectory in the defined field. Particles having unstable trajectories in a three-dimensional quadrupole field obtain displacements from the center of the field which approach infinity over time. Such particles can be thought of escaping the field and are consequently considered untrappable.

For a three-dimensional quadrupole field difined by U, V, $r_0$ and $\omega$, the locus of all possible mass-to-charge ratios maps onto the stability diagram as a single straight line running through the origin with a slope equal to $-2U/V$. (This locus is also referred to as the scan line.) That portion of the loci of all possible mass-to-charge ratios that maps within the stability region defined the region of mass-to-charge ratios applied field. By properly choosing the magnitude of U and V, the range of specific masses to trappable particles can be selected. If the ratio of U to V is chosen so that the locus of possible specific masses maps through an apex of the stability region (line a of FIG. 2) then only particles within a very narrow range of specific masses will have stable trajectories. However, if the ratio of U to V is chosen so that the locus of possible specific masses maps through the middle of the stability region (line b of FIG. 2) then particles of a broad range of specific masses will have table trajectories.

According to the present invention the ion trap is operated in the chemical ionization mode. Reagent gases are introduced into the trap at pressures between $10^{-8}$ and $10^{-3}$ torr and analyte gas are introduced into the ion trap at pressures between $10^{-5}$ and $10^{-8}$ torr. Both the reagent and analytic gases are at low pressures in contrast to conventional chemical ionization. With both reagent and analyte gas present in the ion trap, the three-dimensional trapping field is turned on, and the filament lens is switched so that electrons may enter the device for a certain ionization period. The electron beam will ionize both reagent and analyte gas. The ions formed from the analyte during electron impact ionization are ejected by one of the following combinations of RF and DC trapping fields:

(1) During the ionization period, the RF and DC fields are adjusted such that only low mass ions are stored, for example, ions below a molecular weight of 30 in the case of frequently used chemical ionization reagent gases like methane, water or ammonia.

(2) During the ionization event, the RF and DC fields are adjusted so that only a narrow range of masses, including that of the reagent gas species, is stored.

(3) After the ionization event, the RF and DC fields are adjusted so that all masses above a certain limit are ejected even if they were stored during ionization, and only reagent ions below the mass limit remain stored.

(4) After the ionization event, the RF and DC fields are adjusted so that all masses outside a narrow range of masses are ejected even if they were stored during ionization, and only reagent ions in the selected mass range remain stored.

In the case of certain reagent gases, the ionic species to ionize the analyte molecule is formed by a reaction between the reagent gas ions formed during electron impact ionization and the reagent gas neutrals. For example, the primary ions created during electron impact ionization of water have the mass 18; these ions will then react with the neutral water molecules to form the secondary reagent ion of mass 19. Formation of the secondary reagent ions is achieved by one of two ways:

(1) The reagent gas pressure is high enough so that during ionization all primary reagent gas ions react to form the secondary reagent gas ions; or (2) After the ionization period, a suitable delay period is used to allow the primary reagent gas ions to react with the reagent gas neutrals to form the secondary reagent ion. During this time, the RF and DC fields are adjusted so that only the primary and secondary reagent gas ions are stored.

Then, the three-dimensional trapping field is adjusted such that both reagent ions and analyte ions are stored. The analyte ions are formed by a reaction of the reagent gas ions with the neutral analyte molecule. A sufficient reaction time is allowed to let the analyte ions form. The number of analyte ions formed depends on the number of reagent gas ions present at the start of the reaction, of the length of the reaction time, on the partial pressure of the analyte gas and on the reaction rate. After the analyte ions have been formed, they are mass-analyzed by changing the three-dimensional field whereby analyte ions of different masses are successively ejected and detected to provide a mass spectrum.

Figure 3:
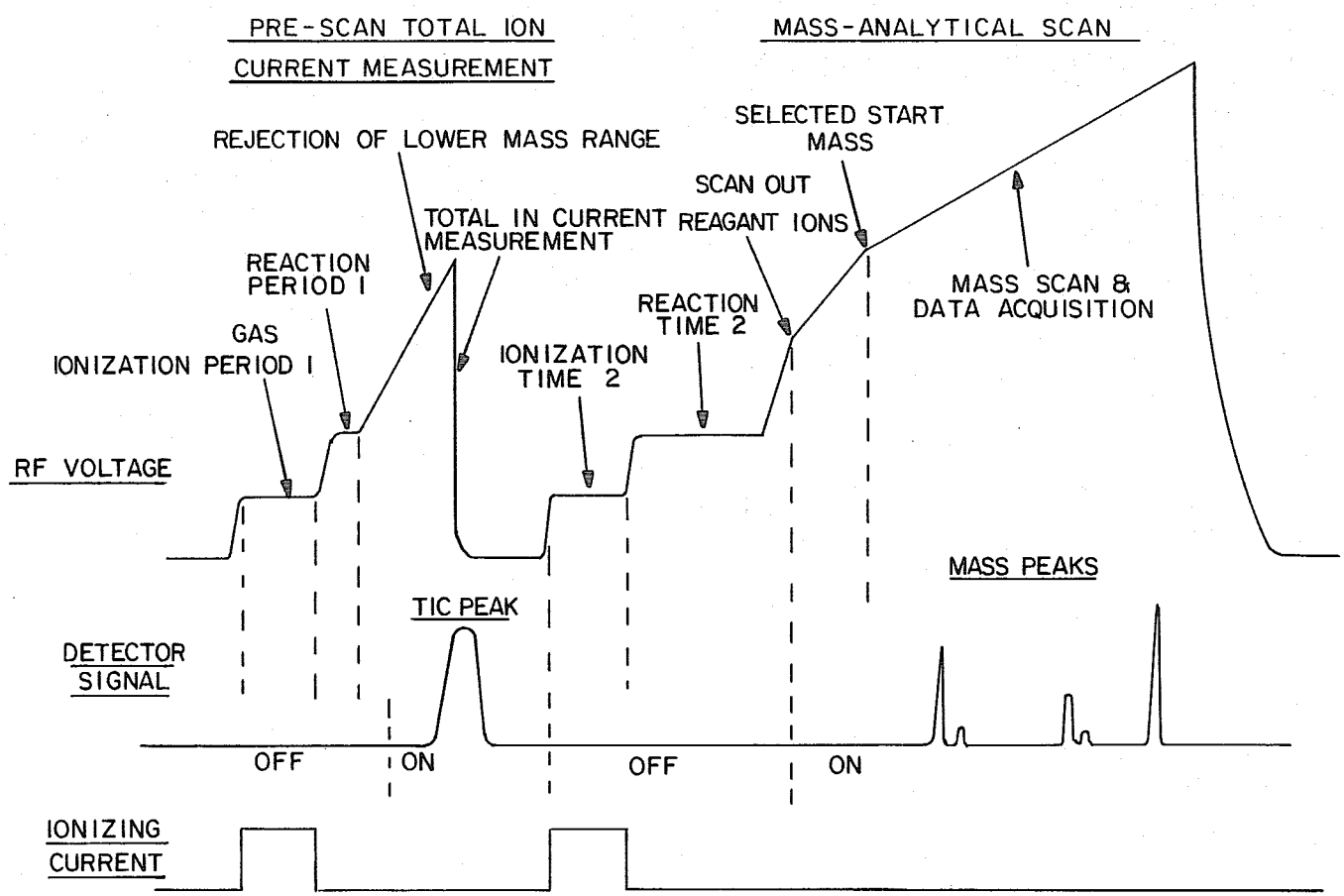
FIG. 3 shows the prescan and mass analysis scanning program for an ion trap mass spectrometer operating in the chemical ionization mode.

According to the present invention, improved performance of the ion trap in CI mode is achieved by performing a prescan, which is followed by an analytical scan as described above. Referring to FIG. 3, the prescan consists of the following steps:

(1) Reagent gas ions are produced during the reagent gas ionization period 1. They are produced using one of the methods described above. As an example, according to FIG. 3 the reagent ions are produced with an RF field that is so low that only the low-mass reagent ions of a suitable reagent gas are stored;

(2) The RF voltage is increased and analyte ions are formed during the reaction period 1;

(3) The RF scanning, ejecting all masses up to a preselected mass. Only higher-mass analyte ions are left in the device; and (4) The stored product ions are ejected from the trap as a "total ion current" peak. This can be achieved by dropping the RF voltage to zero, as shown in FIG. 3, or by a suitable combination of RF and DC voltages applied to the electrodes.

As a result, the ions still stored in the trap are ejected. The total ion current, TIC, is measured and recorded.

Reagent gas ionization period 1 and reaction period 1 are of certain, fixed durations. The number of analyte ions formed in the prescan and detected as the TIC peak depends on analyte pressure and analyte reaction rates. The higher the analyte pressure, the more ions will be detected in the prescan TIC measurement; the higher the analyte reaction rate, the more analyte ions will also be detected in the prescan TIC measurement.

The total ionization current is then compared in the computer, FIG. 1, with an optimum TIC that is desired for recording the mass spectrum during the mass scan and data acquisition step. The optimum TIC is one in which large analyte ion currents are desired for good signal-to-noise ratios in the detection of trace amounts of analyte and yet the analyte ion currents are not so large as to result in the loss of resolution in the mass spectrum.

The optimum TIC is established by a suitable calibration method and stored in the computer where it can be compared with the actual TIC. After comparing the actual TIC from the prescan with the optimum TIC, the computer adjusts the reaction parameters, incuding ionization time 2 and reaction time 2, FIG. 3, so that in the analytical scan the optimum TIC will be produced and the mass spectrum is recorded.

The analytical scan consists of the following steps:

(1) Reagent gas ions are produced during the reagent gas ionization time 2. Again, they may be produced in one of the ways described above;

(2) Analyte ions are formed during the reaction time 2;

(3) The reagent gas ions are scanned out of the device whereby only the analyte ions are still stored;

(4) The three-dimensional field is adjusted so that the desired start mass for recording the analyte mass spectrum is reached; and (5) The analyte mass spectrum is recorded by changing the three-dimensional field whereby analyte ions of different masses are successively ejected and detected.

In the prior art, the ion trap is operated in chemical ionization mode with fixed reaction parameters. This limits the sensitivity and dynamic range of analyte pressures in which useful spectra can be obtained.

With the present invention, the reaction parameters are adjusted automatically based on a prescan TIC measurement. The result is an improved sensitivity and increased dynamic range.

What is claimed is:

1. A method of using an ion trap in a CI mode which comprises performing a prescan including the steps of introducing the analyte and reagent gas molecules into an ion trap having a three dimensional quadrupole field in which ions are stored, ionizing the mixture with an applied RF voltage chosen to selectively store primarily the reagent ions, allowing the reagent ions and analyte molecules to react and thereafter changing the three dimensional field to allow the products of reactions between the analyte molecules and the reactant ions to be trapped, ejecting and detecting these product ions to obtain a signal indicating the concentration of product ions, adjusting the ionization and/or reaction time to produce an optimum or suitable number of stored product or analyte ions for the following mass analysis step and performing a mass analysis including the steps of introducing analyte and reagent gas molecules into the ion trap having a three dimensional quadrupole field in which low mass ions are stored, ionizing the mixture with RF voltage applied to selectively store primarily the reagent ions for the amount of time determined during said prescan, allowing the reagent ions and analyte molecules to react for the amount of time determined during said prescan and thereafter changing the three dimensional field to allow the products of reactions between the analyte molecules and the reactant ions to be trapped and scanning the three dimensional field to successively eject the product ions and detecting the product ions to obtain a CI mass spectrum of the analyte.

2. A method as in claim 1 in which during ionization the RF field is adjusted to store only low mass ions.

3. A method as in claim 1 in which during the ionization period the RF field is adjusted to trap a narrow range of masses including those of the reagent ion species.

4. A method as in claim 1 in which after ionization the RF field is adjusted so that all masses above a predetermined limit are ejected.

5. A method as in claim 1 in which after ionization the RF field is adjusted so that masses within a narrow range of masses are trapped.

6. A method as in claim 1 in which the reagent gas pressure is selected to be high enough so that during ionization all primary reagent ions react to form secondary reagent ions.

7. A method as in claim 1 in which after the ionization period a delay period is provided to allow primary reagent ions to react with reagent gas neutrals to form secondary ions.

* * * * *